United States Patent [19]

Miller

[11] Patent Number: 5,062,377

[45] Date of Patent: Nov. 5, 1991

[54] POLE-LATCH ATTACHMENT FOR JET SKI

[76] Inventor: Randolph D. Miller, 14037 N. 41st St., Phoenix, Ariz. 85032

[21] Appl. No.: 623,518

[22] Filed: Dec. 7, 1990

[51] Int. Cl.[5] ..... B63B 35/73

[52] U.S. Cl. ..... 114/270; 114/144 R

[58] Field of Search ..... 114/144 R, 160, 270; 74/480 B, 493

[56] References Cited

U.S. PATENT DOCUMENTS 3,826,220 7/1974 Jacobson ..... 114/270

4,989,532 2/1991 Kishi et al. ..... 114/270

*Primary Examiner*—Sherman Basinger

*Assistant Examiner*—Stephen P. Avila

*Attorney, Agent, or Firm*—Tod R. Nissle

[57] ABSTRACT

A motorized water ski. The motorized ski includes a hull body, an engine to propel the hull body, and a long steering handle or pole pivotally attached to the hull body. The ski includes a pole-latch attachment which can be used to maintain the steering pole in a fixed upright storage position while maintenance is performed on the engine of the jet ski.

3 Claims, 5 Drawing Sheets

FIG. 1 (PRIOR ART)
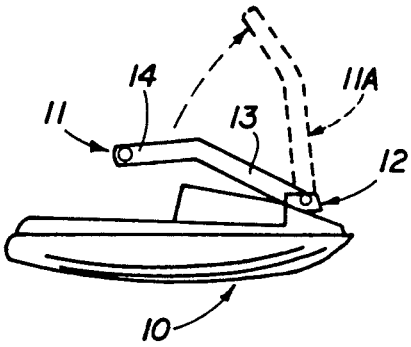
FIG. 4
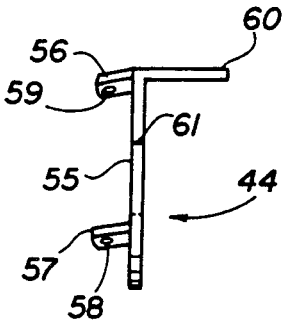
FIG. 5
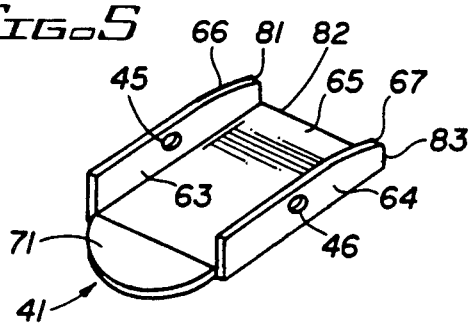
FIG. 6
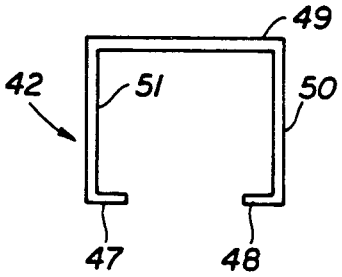
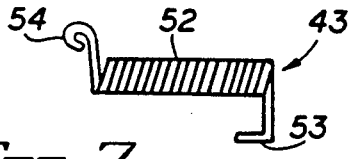
FIG. 7

POLE-LATCH ATTACHMENT FOR JET SKI

This invention relates to an attachment which provides improvements in motorized water skis, commonly known as "jet skis", which include a hull body, an engine to propel the hull body, and a long steering handle or pole pivotally attached to the hull body.

In another respect, the invention pertains to an attachment which can be integrated with an existing jet ski to maintain the steering pole in a fixed upright storage position while maintenance is performed on the engine of the jet ski.

Jet skis, in particular KAWASKI jet skis model numbers JS300, JS440, and JS550, each comprise a hull body, an engine mounted in the hull body to provide motive power to drive the jet ski through water, and a long steering handle or pole. The steering handle includes a distal end which the user of the jet ski grasps while riding the ski through water. The steering handle also includes a lower end. The lower end is pivotally attached to a U-shaped bracket which includes a bottom plate and a pair of upstanding, opposed, spaced apart flange plates. The bottom plate is bolted to the hull body. The flange plates each have a circular hole formed through the plate. These holes oppose one another and receive a bolt or pin.

The bolt also passes through the lower end of the steering handle, which pivots about the bolt. Each flange plate also includes a U-shaped aperture formed through the plate. The U-shaped apertures oppose one another. These U-shaped apertures function to assist in supporting the steering handle in an upright position, as is further described below.

An elongate U-shaped member is utilized to latch the engine cover of the jet ski in closed position. Once this U-shaped member is freed from the engine cover the U-shaped member can, when the steering handle is in the upright position, be slid through the U-shaped apertures and span the distance between the flange plates. During normal operation of the jet ski, the steering handle 11 extends upwardly and outwardly from the hull body and is generally parallel to the longitudinal axis of the body, as shown in FIG. 1 of the drawings. In order to maintenance the engine of the jet ski, the handle 11 must be upwardly displaced to the position indicated by dashed lines 11A in FIG. 1. When the handle is in the upright position indicated by dashed lines 11A, it must be held with one hand. The user's other hand is used to remove the U-shaped latch member from the engine cover. Once the U-shaped latch member is removed from the engine cover, the user slides the U-shaped member through the U-shaped apertures in the flange plates. After the U-shaped member is inserted through the U-shaped apertures, it extends between the flange plates 18, 19 in the manner indicated by dashed line 80 in FIG. 3, edges 37 and 38 bear against the U-shaped member, and the U-shaped member supports the steering handle in the upright position represented by dashed lines 11A in FIG. 1. Using one hand to remove the U-shaped member from the engine compartment and insert the U-shaped member in the U-shaped apertures is difficult to do, even if the user has both hands free. But both of the user's hands are not free. One hand is occupied holding the steering handle in the upright position indicated by dashed lines 11A in FIG. 1. In fact, if the user is standing in shallow water with a jet ski and is attempting to gain access to the engine, it basically is nearly impossible for the user to hold the handle upright and at the same time to remove the U-shaped latch member from the engine compartment and insert it in the U-shaped receiving apertures formed in the flange plates.

Accordingly, it would be highly desirable to provide a method and apparatus for supporting the jet ski steering handle as soon as the handle is raised to the upright position indicated by dashed lines 11A in FIG. 1.

It would also be highly desirable to provide a method and apparatus which would afford support for the jet ski steering handle as soon as the handle was raised to an upright position and which would be readily operable with the free hand of a user who is holding the steering handle upright with his other hand.

Therefore it is a principal object of the invention to provide an improved motorized ski, commonly known as a "jet ski".

A further object of the invention is to provide an improved jet ski of the type including a hull body, an engine mounted in the hull body to propel the jet ski, and an elongate steering handle pivotally attached to the hull body.

Another object of the invention is to provide an improved jet ski of the type described which enables a single individual to readily raise the steering handle of the jet ski to a desired position and to secure the handle in said desired position.

Still a further object of the invention is to provide an attachment which can be utilized to secure the handle of a jet ski in a desired position and which can be simply and readily attached to an existing jet ski by persons of limited mechanical skill using conventional, simple hand tools.

These and other, further and more specific objects and advantages of the invention will be apparent to those skilled in the art from the following detailed description thereof, taken in conjunction with the drawings, in which:

FIG. 1 is a side view illustrating a conventional jet ski;

FIG. 4 is a side view illustrating a component of the latch attachment shown in FIG. 3;

FIG. 5 is a perspective view illustrating a component of the latch attachment shown in FIG. 3;

FIG. 6 is a top view illustrating another component of the latch attachment shown in FIG. 3;

FIG. 7 is a top view illustrating yet another component of the latch attachment shown in FIG. 3;

Briefly, in accordance with my invention, I provide a latch attachment for an existing motorized water ski. The motorized water ski includes a hull body; motive power means mounted on the body for propelling the body through water; a support member attached to the hull body and including at least one flange means, the flange means including an aperture formed therethrough; an elongate steering handle extending outwardly from the body and having a distal end and a proximate end, the proximate end being attached to the flange means to permit movement of the handle between at least two operative positions, a primary operative position, and a secondary operative position with the distal end of the steering handle pivoted from the first operative position outwardly away from the hull body such that an object can be slid through the aperture and adjacent the steering handle. The latch attachment is operable to support the handle in the secondary operative position and prevent the handle from moving from the secondary to the primary operative position. The attachment comprises mounting means attached to one of the pair comprising the flange means and hull body; and, spring loaded latching means attached to the mounting means and shaped and dimensioned to extend through the aperture when the handle is in the secondary operative position to prevent the handle from moving from the secondary operative position to the primary operative position. The latching means is movable between at least two operative positions, a first support operative position with the latching means extending through the aperture and adjacent the handle when the handle is in the secondary operative position to prevent the handle from moving from the secondary to the primary operative position; and, a second storage operative position with the latching means at least partially withdrawn through the aperture from the first operative position such that the handle is free to move from the secondary to the primary operative position.

Figure 2:
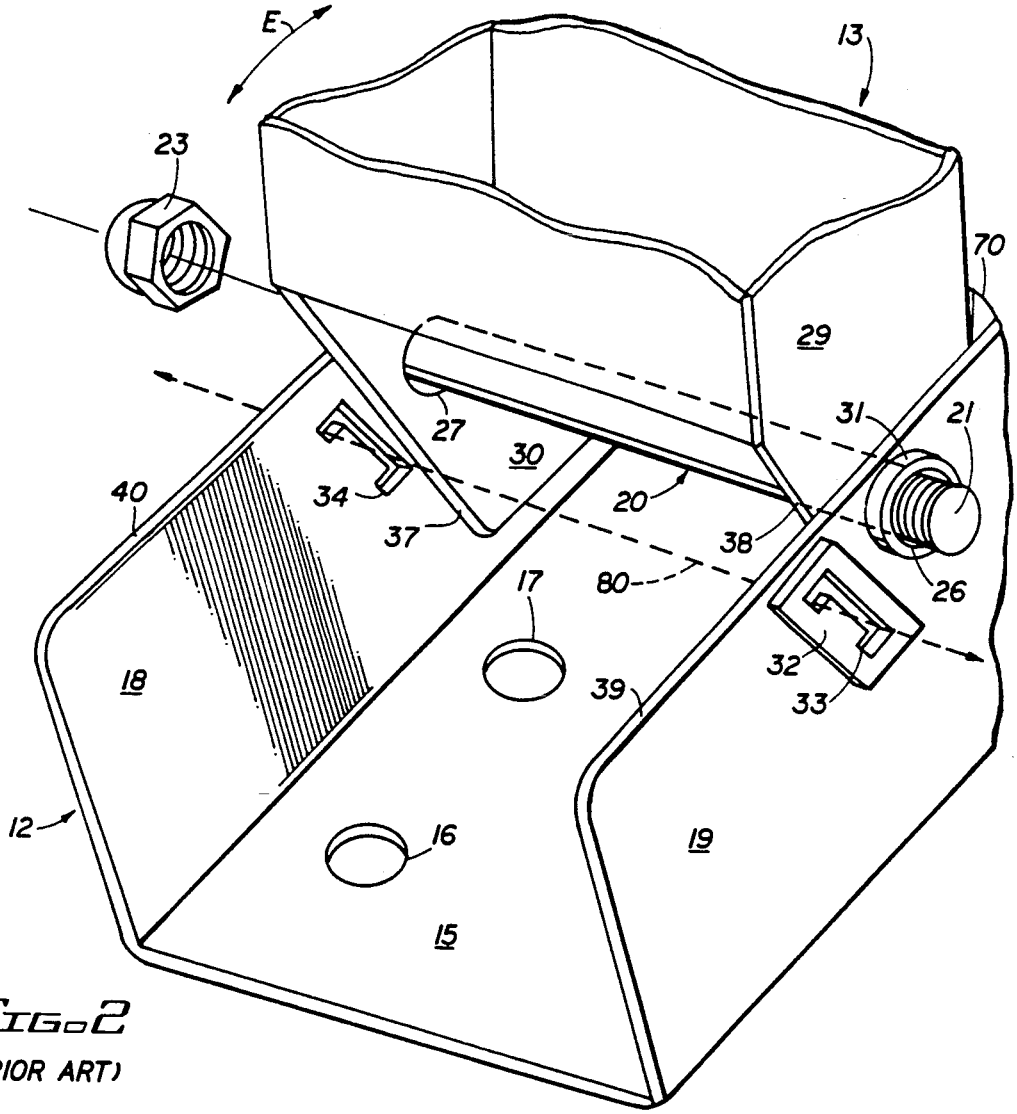
FIG. 2 (PRIOR ART)
FIG. 2 is a perspective view illustrating how the steering handle of the jet ski of FIG. 1 is attached to the hull body of the ski.

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 illustrates a conventional motorized water ski, or "jet ski", including hull body 10, elongate substantially rigid steering arm or pole 11, and bracket or support member 12 which pivotally secures the lower end 13 of the steering handle to the front of the hull body 10. The distal end 14 of the steering handle 11 includes a handle which is grasped by an individual riding the jet ski. An enlarged illustration of bracket or support member 12 is shown in FIG. 2. Support member 12 includes a bottom plate 15 which is secured to hull body 10 with threaded bolts (not shown) which pass through apertures 16 and 17 and turn into hull body 10. Flange plates 18 and 19 are of equal shape and dimension and upwardly depend from bottom plate 15. Circular openings 25 (not visible) and 26 formed through plates 18 and 19 slidably receive bolt or pin 20. Ends 22 (not visible) and 21 of bolt 20 are externally threaded and each receive an internally threaded nut 23 and 24 (FIG. 3), respectively. Apertures 28 (not visible) and 27 are formed through side plates 29 and 30, respectively, also receive pin 20 such that lower end 13 and, consequently, handle 11 pivot about pin 20 in the manner indicated by arrows E in FIG. 2. Flange plate 19 includes outwardly projecting raised areas or shelves 31 and 32 formed around apertures 26 and 33, respectively. Flange plate 18 also includes outwardly projecting raised areas or shelves (not visible) formed around apertures 25 (not visible) and 34. U-shaped apertures 33 and 34 extend through plates 19 and 18, respectively. Plates 18 and 19 are parallel to one another and to side plates 29 and 30. Plate 30 includes leading edge 37. Plate 29 includes leading edge 38. Plate 19 includes upper edge 39. Plate 18 includes upper edge 40.

Figure 3:
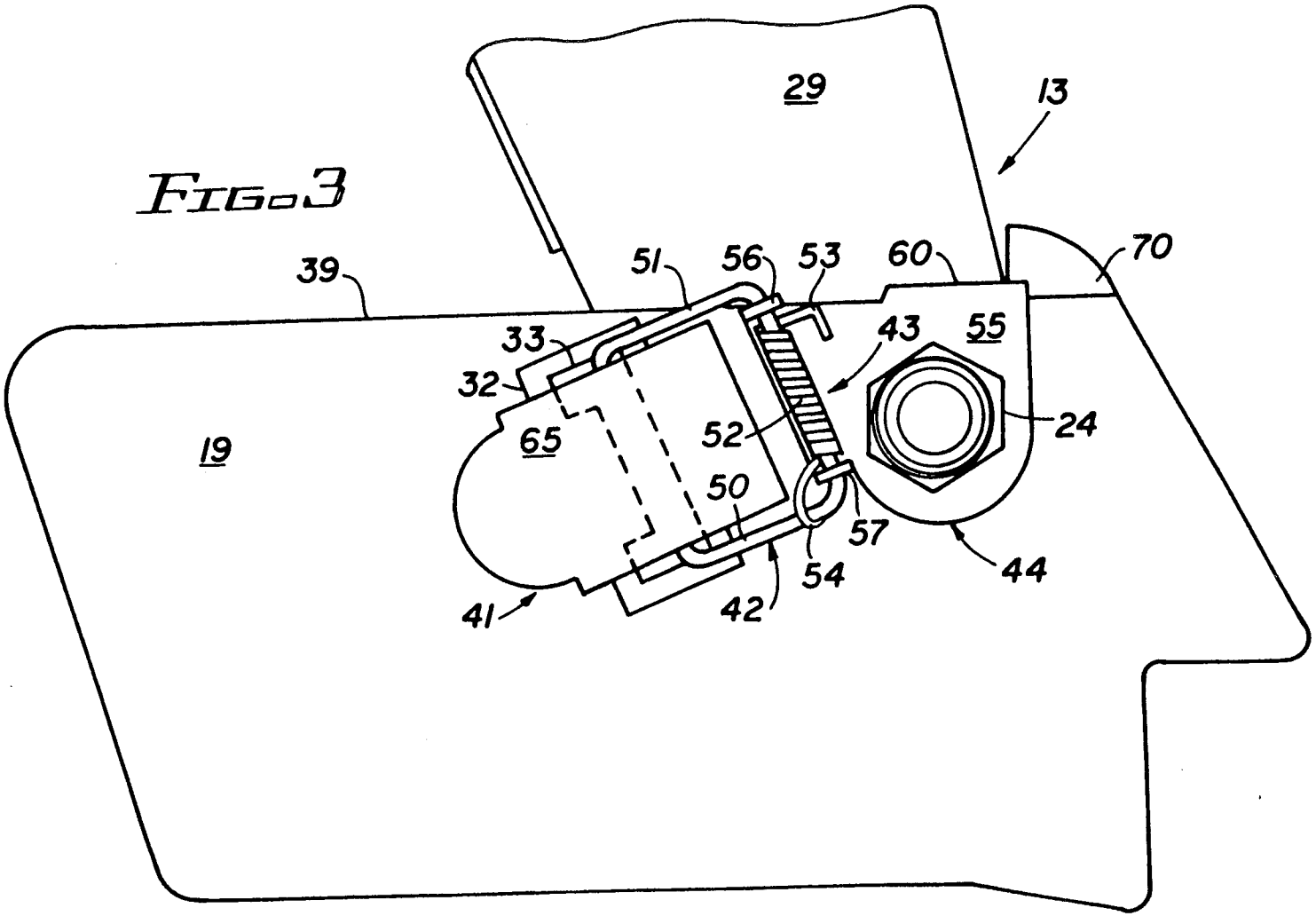
FIG. 3 is a side view of the jet ski steering handle mounting bracket equipped with a latch attachment constructed in accordance with the principles of the invention.

FIG. 3 illustrates a latch attachment constructed in accordance with the principles of the invention and mounted on end 21 of bolt 20 adjacent plate 19. As would be appreciated by those of skill in the art, a similar attachment can be mounted on end 22 of bolt 20 adjacent plate 18. End 22 of bolt 20 extends outwardly away from plate 18 and lower end 13 in the same manner that end 21 extends outwardly away from plate 19 and lower end 13. The attachment of FIG. 3 includes a latch 41, U-shaped wire member 42, torsion spring 43, and panel member 44. As can be seen with reference to FIGS. 4 to 7, in FIG. 3 fingers 47 and 48 of member 42 extend into apertures 45 and 46 formed through side members 63 and 64 of latch 41. Neck 49 of wire member 42 passes through and is circumscribed by wound portion 52 of torsion spring 43. Leg 53 of torsion spring 43 bears against flat portion 55 of member 44. Leg 54 of spring 43 wraps around and engages leg 50 of wire member 42. Neck 49 of member 42 also passes through apertures 58 and 59 formed through flange members 57 and 56 of panel member 44. Flange members 56 and 57 are attached to and outwardly project from flat portion 55 of panel member 44. Flat lip portion 60 extends over and contacts upper edge 39 of plate 19. In FIG. 3, externally threaded end 21 (not visible in FIG. 3) extends through a circular aperture 61 (not visible in FIG. 3) formed through flat portion 55 of panel member 44, and nut 24 is threaded onto end 21. In both FIG. 3 and FIG. 2, lower end 13 is shown in the position it occupies when steering handle 11 is in the upright position indicated by dashed lines 11A in FIG. 1. Ordinarily, when the jet ski of FIG. 1 is being operated, the steering handle is in the position indicated by reference character 11 and is not in the upright position indicated by reference character 11A. The steering handle is maintained in the upright position indicated by dashed lines 11A when the jet ski user wishes to access the engine compartment of the jet ski. When the lower end 13 of the steering handle 11 is in the position shown in FIGS. 2 and 3, end 13 bears against a rubber bumper 70 which extends across the front of support member 12 and is generally parallel to bottom plate 15.

Figure 8A:
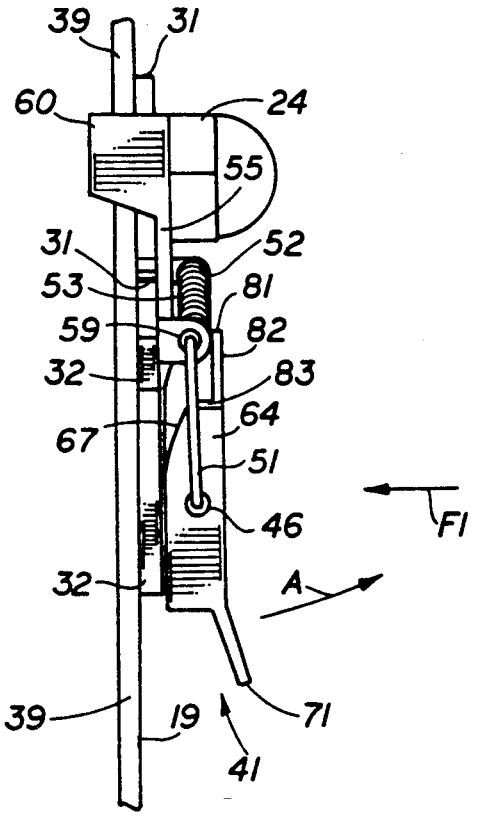
FIG. 8A is a top view illustrating the latch attachment of FIG. 3.
Figure 8B:
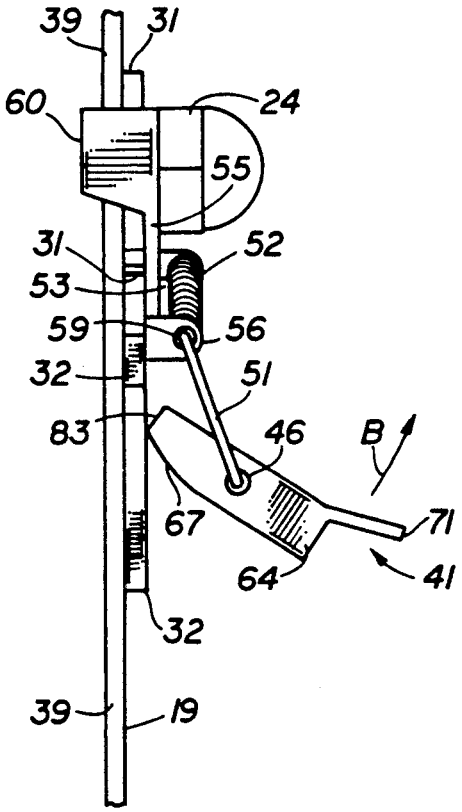
FIG. 8B is a top view of latch attachment of FIG. 8A illustrating the mode of operation thereof.

When the latch attachment shown in FIG. 3 is used, latch 41 is moved into a position in which it extends through U-shaped aperture 33 a sufficient distance to contact leading edge 38 of plate 29 and to maintain the lower end 13 of the steering handle 11 in the upright position illustrated in FIGS. 2 and 3. The mode of operation of the attachment of FIG. 3 is explained with reference to FIGS. 8A to 8C. In FIG. 8A, the latch attachment is shown in the position illustrated in FIG. 3, with side members 63 and 64 of latch 41 contacting shelf 32 and with flat panel portion 65 of latch 41 spaced apart from and parallel to shelf 32. Torsion spring 43 is mounted on wire member 42 such that leg 54 continuously forces member 42 and, consequently, latch 41 downwardly against shelf 32 with a force acting in the direction indicated by arrow Fl in FIG. 8A.

In use of the attachment of FIG. 8A, semicircular panel lip 71 is grasped and pulled outwardly away from plate 19 in the direction of arrow A in FIG. 8A. Pulling lip 71 outwardly in the direction of arrow A causes latch 41 and member 42 to move. Leg 54 of spring 43 also moves with leg 50 of member 42, but the leg 53 of spring 43 remains stationary during movement of latch 41. Wound portion 52 of spring 43 is slightly "wound" or "unwound" during the movement of latch 41, but portion 52 generally remains stationary. Panel member 44 stays in fixed position during movement of latch 41. Lip portion 60 of member 44 extends over edge 39 to prevent portion 55 from rotating about end 21 during any movement of spring-loaded latch 41.

When in FIG. 8A latch 41 is manually pulled outwardly in the direction of arrow A, arcuate surfaces 66 and 67 pivot against and roll and slide over shelf 32 to facilitate the movement of latch 41 with respect to shelf 32. While arcuate surfaces 66 and 67 roll and slide over shelf 32, latch 41 pivots about fingers 47 and 48 and legs 50 and 51 pivot or rotate with respect to apertures 58, 59 and flange members 57 and 56. After latch 41 reaches the intermediate operative position shown in FIG. 8B, the user continues to pull lip 71 in the direction of arrow B until the end edges or surfaces 81 to 83 are over and aligned with U-shaped aperture 33. Latch 41 and surfaces 81 to 83 are shaped and dimensioned such that as soon as surfaces 81 to 83 are over and aligned with aperture 33, torsion spring 43 forces surfaces 81 to 83 and a portion of latch 41 through aperture 33 in the direction of arrow C in FIG. 3. Latch 41 travels through aperture 33 in the direction of arrow C until portions of legs 50 and 51 of wire member 42 contact shelf 32 and prevent any further movement of latch 41 in the direction of arrow C. Once latch 41 is in the position illustrated in FIG. 8C, leading edge 38 of plate 29 bears against latch 41 in the manner indicated by dashed lines 29A and 30A in FIG. 8C and latch 41 supports the steering handle in the position indicated by dashed lines 11A in FIG. 1 and indicated by lower end 13 in FIGS. 2 and 3. Latch 41 is removed from aperture 33 using a sequence of steps which is the reverse of those just described in FIGS. 8A to 8C to insert latch 41 in aperture 33. Latch 41 is removed from aperture 33 by grasping lip 71 and pulling it outwardly in a direction opposite that indicated by arrow C.

Figure 8C:
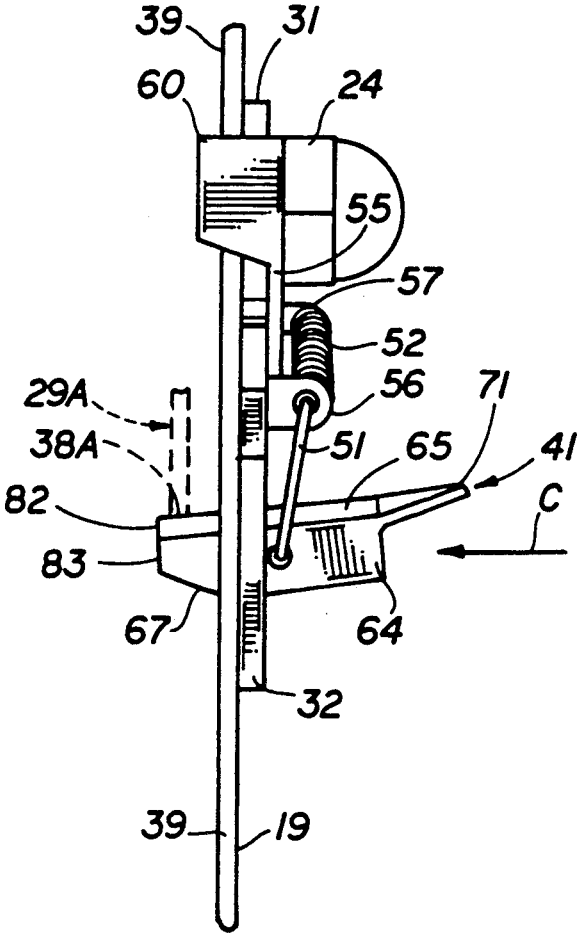
FIG. 8C is a top view of the attachment of FIG. 8A further illustrating the mode of operation thereof; and, FIG. 9 is a perspective view of a protective bracket utilized in the practice of the invention.

Part of the merit of the attachment of the invention lies in the fact that latch 41 can be readily moved from the position shown in FIG. 8A to the position shown in FIG. 8C by simply pulling on lip 71 with the fingers of one hand to pivot latch 41 over and into aperture 33. The other hand can be utilized to support the steering handle in the upright position indicated by dashed lines 11A in FIG. 2. Further, the attachment of the invention is easily installed on an existing jet ski by removing nut 24 from end 21, sliding aperture 61 of member 44 over end 21 to the position shown in FIGS. 3 and 8A, and threading nut 24 back onto externally threaded end 21.

Figure 9:
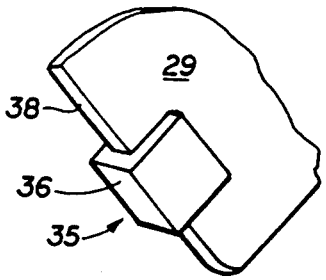

Plates 29 and 30 and handle 11 are typically fabricated from fiberglass. Fiberglass chips, nicks, and wears rather quickly. In use of the invention, it is preferred that a guard 35 (FIG. 9) fabricated from metal or some other material which is tougher and more wear resistant than fiberglass be placed over leading edge 38 at the point or points at which edge 38 contacts latch 41 in FIG. 8C. Alternately, plates 29 and 30 can simply be made out of metal or another material which exhibits improved wear properties in comparison to fiberglass.

Having described my invention in such terms as to enable those skilled in the art to understand and practice it, and having identified the presently preferred embodiments thereof,

I claim:

1. An attachment for a motorized water ski, said ski including a hull body, motive power means mounted on said body for propelling said body through water, a support member attached to said hull body and including at least one flange means, said flange means including an aperture formed therethrough, an elongate steering handle extending outwardly from said body and having a distal end and a proximate end, said proximate end being attached to said flange means to permit movement of said handle between at least two operative positions, a primary operative position, and a secondary operative position with said distal end of said steering handle pivoted from said first operative position outwardly away from said hull body such that an object can be slid through said aperture and adjacent said steering handle, said attachment being operable to support said handle in said secondary operative position and prevent said handle from moving from said secondary to said primary operative position, said attachment comprising (a) mounting means attached to one of the pair comprising (i) said flange means, and (ii) said hull body; and, (b) spring loaded latching means attached to said mounting means and shaped and dimensioned to extend through said aperture when said handle is in said secondary operative position to prevent said handle from moving from said secondary operative position to said primary operative position, said latching means being movable between at least two operative positions, (i) a first support operative position with said latching means extending through said aperture and adjacent said handle when said handle is in said secondary operative position to prevent said handle from moving from said secondary to said primary operative position, and (ii) a second storage operative position with said latching means at least partially withdrawn through said aperture from said first operative position such that said handle is free to move from said secondary to said primary operative position.

2. An attachment for a motorized water ski, said ski including a hull body, motive power means mounted on said body for propelling said body through water, a support member attached to said hull body and including at least one flange means, said flange means including an aperture formed therethrough, an elongate steering handle extending outwardly from said body and having a distal end and a proximate end, said proximate end being attached to said flange means to permit movement of said handle between at least two operative positions, a primary operative position, and a secondary operative position with said distal end of said steering handle pivoted from said first operative position outwardly away from said hull body such that an object can be slid through said aperture and adjacent said steering handle, said attachment being operable to support said handle in said secondary operative position and prevent said handle from moving from said secondary to said primary operative position, said attachment comprising (a) mounting means attached to one of the pair comprising
(i) said flange means, and
(ii) said hull body; and, (b) latching means attached to said mounting means and including a portion shaped and dimensioned to move and extend through said aperture when said handle is in said secondary operative position to prevent said handle from moving from said secondary operative position to said primary operative position, said latching means being movable between at least two operative positions,
(i) a first storage operative position with said latching means positioned adjacent one of said pair, and
(ii) a second operative position with said latching means aligned with said aperture such that said portion of said latching means can, when said handle is in said secondary operative position, be displaced through said aperture to a position to support said handle in said secondary operative position and prevent said handle from being moved from said secondary operative position to said primary operative position;

said latching means being pivoted with respect to said mounting means to move said latching means from said first operative position to said second operative position.

3. An attachment for a motorized water ski, said ski including a hull body, motive power means mounted on said body for propelling said body through water, a support member attached to said hull body and including at least one flange means, said flange means including an aperture formed therethrough, an elongate steering handle extending outwardly from said body and having a distal end and a proximate end, said proximate end being attached to said flange means to permit movement of said handle between at least two operative positions.

a primary operative position, and a secondary operative position with said distal end of said steering handle pivoted from said first operative position outwardly away from said hull body such that an object can be slid through said aperture and adjacent said steering handle, said attachment being operable to support said handle in said secondary operative position and prevent said handle from moving from said secondary to said primary operative position, said attachment comprising (a) mounting means attached to one of the pair comprising
(i) said flange means, and
(ii) said hull body; and, (b) latching means attached to said mounting means to permit said latching means to contact and slide over said flange means and including a portion shaped and dimensioned to move and extend through said aperture when said handle is in said secondary operative position to prevent said handle from moving from said secondary operative position to said primary operative position, said latching means being movable between at least two operative positions,
(i) a first storage operative position, and
(ii) a second operative position with said latching means aligned with said aperture such that said portion of said latching means can, when said handle is in said secondary operative position, be displaced through said aperture to a position to support said handle in said secondary operative position and prevent said handle from being moved from said secondary operative position to said primary operative position;

said latching means sliding over said flange means during movement of said latching means from said first operative position to said second operative position.

* * * * *